US005384756A

United States Patent [19]

Pelosi

[11] Patent Number: 5,384,756

[45] Date of Patent: Jan. 24, 1995

[54] COMBINED IDENTIFICATION DEVICE AND TIMEPIECE

[76] Inventor: Raymond K. Pelosi, 1318 40th St., Brooklyn, N.Y. 11218

[21] Appl. No.: 130,749

[22] Filed: Oct. 4, 1993

Related U.S. Application Data

[63] Continuation-in-part of Ser. No. 895,651, Jun. 9, 1992.

[51] Int. Cl.[6] ..... G04B 45/00

[52] U.S. Cl. ..... 368/281; 368/10; 368/223

[58] Field of Search ..... 368/280, 281, 282, 10, 368/223

[56] References Cited

U.S. PATENT DOCUMENTS

| | | | |
|---|---|---|---|
| D. 130,987 | 12/1941 | Dennis . | |
| D. 183,267 | 7/1958 | Raber et al. . | |
| D. 183,462 | 9/1958 | Maiershofer . | |
| D. 270,296 | 1/1883 | Foster . | |
| D. 273,057 | 2/1883 | Foster . | |
| D. 278,609 | 4/1985 | Satterelli . | |
| 296,741 | 4/1884 | Gould | 40/10 |
| D. 300,145 | 3/1989 | Nord . | |
| 1,537,899 | 5/1925 | Stubbs . | |
| 1,629,040 | 5/1927 | McGrevy | 368/281 |
| 1,954,249 | 4/1934 | Kehl | 368/281 |
| 2,166,687 | 7/1939 | Kehl | 368/281 |
| 2,185,641 | 1/1940 | Mark | 40/10 |
| 2,235,095 | 3/1941 | Barthman | 368/281 |
| 2,334,483 | 11/1943 | Dennis . | |
| 2,615,366 | 10/1952 | Rothweiler . | |
| 2,943,409 | 7/1960 | Maiershofer . | |
| 2,986,064 | 5/1961 | Chromy . | |
| 3,076,276 | 2/1963 | Pitchford . | |
| 3,178,842 | 4/1965 | Zimmerman | 40/10 |
| 4,197,665 | 4/1980 | Siiter . | |
| 4,249,330 | 2/1981 | Chioffe . | |
| 4,435,912 | 3/1984 | Adrian et al. . | |
| 4,468,874 | 9/1984 | Chiodo . | |
| 4,574,505 | 3/1986 | Chiodo . | |
| 4,903,250 | 2/1990 | Cho | 368/41 |

*Primary Examiner*—Bernard Roskoski
*Attorney, Agent, or Firm*—Dennis H. Lambert

[57] ABSTRACT

A combined timepiece and identification device (10, 50) contains personal identification and/or medical information about the person wearing the device. The device includes a housing (13, 51) in which first and second panels (30, 31 or 58, 59) are hingedly mounted for movement between closed positions stored in the housing and exposed positions generally parallel to one another outside the housing at opposite ends thereof. One of the panels carries a piece of microfilm (38, 60) containing the information, and the other panel carries a lens (39, 61) adapted to focus on the microfilm when the panels are in their opened positions outside the housing. The timepiece (11, 50) comprises an openable cover (20, 63) for the housing so that the panels are enclosed and protected when the cover is closed. Springs (36, 37 or 71, 72) urge the panels toward their opened, unfolded positions when the cover is opened.

9 Claims, 8 Drawing Sheets

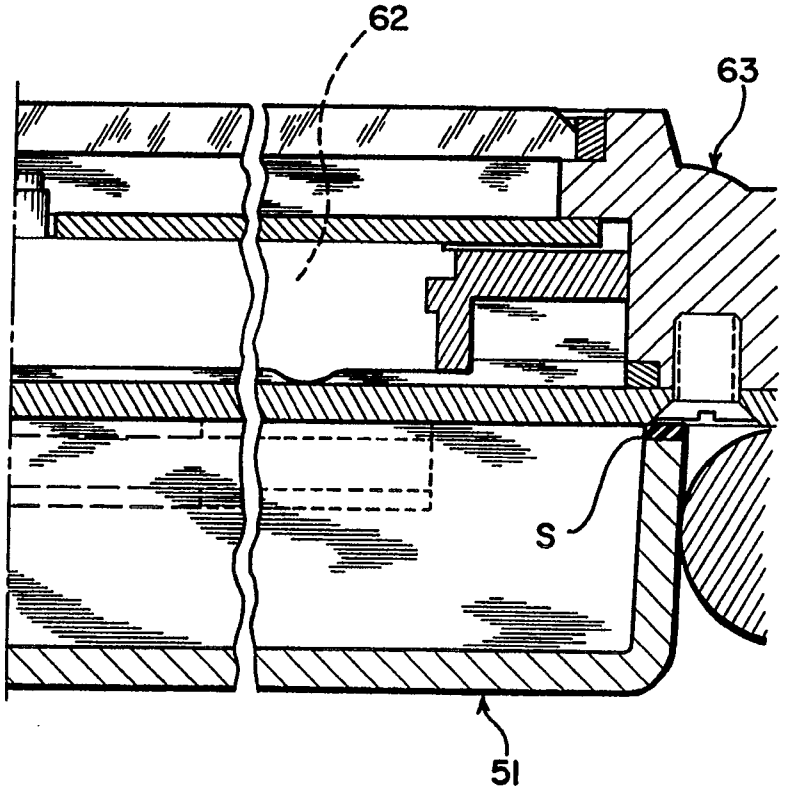
FIG. 11
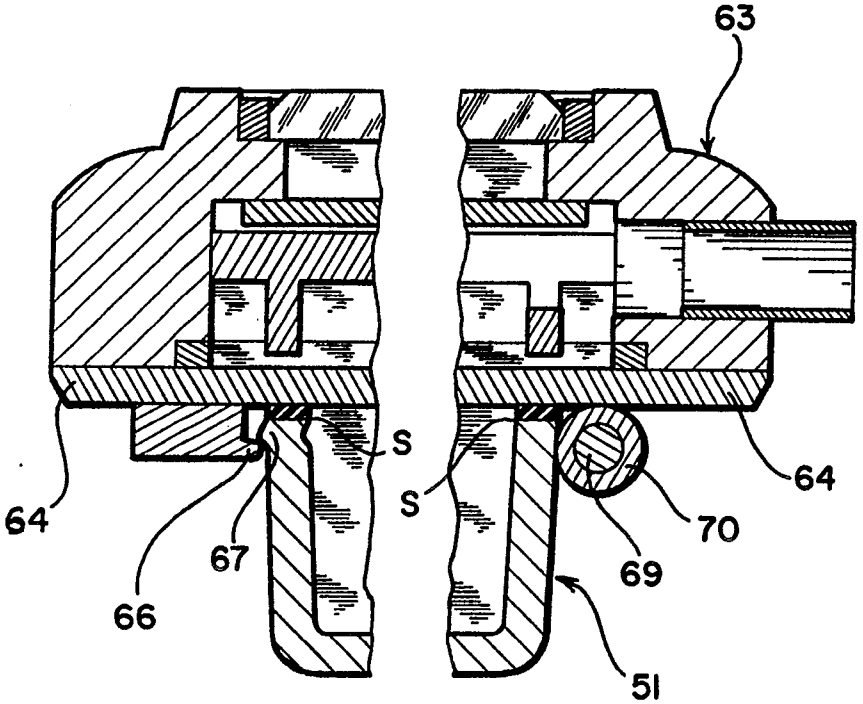
FIG. 9
FIG. 10

COMBINED IDENTIFICATION DEVICE AND TIMEPIECE

This application is a continuation-in-part of copending application Ser. No. 07/895,651, filed Jun. 9, 1992, and entitled Identification Pendant.

TECHNICAL FIELD OF THE INVENTION

This invention relates to devices for displaying personal information, and especially to a device that contains medical information and/or other personal identification that may be needed in an emergency situation. More particularly, the invention relates to a combined identification device and timepiece.

BACKGROUND ART

People are sometimes subjected to conditions that require them to undergo emergency medical treatment. Such treatment may typically involve the administration of blood and/or drugs, or may require other procedures that could cause further harm to the person if certain precautions are not taken. For instance, it is essential to know the blood type of persons receiving blood transfusions, and to know if that person is allergic or otherwise experiences adverse reactions to certain drugs. Further, medical devices or prostheses, such as a heart pacemaker, or contact lenses or the like may be worn by the person being treated. In addition, there may be aspects of that person's medical history which are essential to proper treatment, whereby consultation with that person's personal physician would be desirable in order to obtain the medical history or other data useful in the treatment of the person.

In many instances, the person who must receive emergency medical treatment is either unconscious or otherwise unable to be of assistance to rescue and/or medical personnel at the time treatment is needed. Thus, the information noted above, and essential to the treatment of the person, may not be readily and quickly obtainable from the person or from normal channels of such information.

To solve this problem, various devices are typically employed in the prior art, including cards that are adapted to be carried in a person's wallet or pocketbook, or I.D. tags and the like that may be worn about the neck of the person. Miniaturized viewers have also been devised, carrying medical and other personal information on a small piece of microfilm that may be read through a lens provided on the device.

Thus, in a medical emergency the treating physician has immediate access to critical medical information that could save the life of a person wearing such a device.

A variety of miniaturized viewing devices for containing medical information are disclosed in U.S. Pat. Nos. 3,178,842, 4,249,330, 4,435,912, 4,468,874 and 4,574,505.

U.S. Pat. Nos. 3,178,842, 4,468,874 and 4,574,505 all describe collapsible viewers having one part that carries a piece of microfilm and another part that carries a lens for viewing the microfilm. These devices are relatively complex in construction and assembly, adding to their cost. Moreover, when they are in their collapsed, inoperative condition they tend to be unsightly, and may discourage some persons from wearing them in a readily visible position, such as on a necklace or bracelet. If the device is worn or carried in a location that is normally out of sight, such as in a pocket or the like, its utility is significantly diminished, since medical personnel may be reluctant or even prohibited from searching a person in an effort to locate such a device.

U.S. Pat. No. 4,435,912 describes a card that is adapted to be carried in a wallet or pocketbook or the like, and which includes a piece of microfilm on one part and a lens on another part that may be bent into operative relationship with one another so that the film can be viewed. This device is susceptible to damage from the environment, and is normally carried in a pocket or other location that may prevent its being discovered by personnel attending to the treatment of the person.

U.S. Pat. No. 4,249,330 discloses a device that has a fixed, closed housing with a lens in one end and a piece of microfilm in the other end. Although the lens and film are protected from many potentially damaging elements in the environment, the construction of the device still renders the lens and film susceptible to the collection of dirt or other foreign matter which might make the film difficult or impossible to read. Moreover, the fixed relationship of the film-carrying part to the lens-carrying part dictates a particular size to the device, and even though the device is described as capable of being worn as a piece of jewelry, it would appear to be relatively large and may discourage some from wearing it as jewelry.

There is thus need for a device that carries medical and/or other personal information, and which is small and attractive so as to encourage its use in a readily visible location, and further, which has means to normally protect the operative components thereof from dirt or other foreign matter. A further desired feature would be to give such a device an additional function to encourage its use at all times.

DISCLOSURE OF THE INVENTION

In accordance with the present invention, a device for carrying medical and/or other personal information includes collapsible components so that it is small and compact in design, and has a housing to protect the sensitive components from environmental damage. It is also preferably designed so that it is attractive to wear as a piece of jewelry or to provide some other function, such as a timepiece.

More specifically, the identification device has one foldable panel that carries a piece of microfilm with medical information or the like thereon, and another, opposed foldable panel that carries a lens for viewing the microfilm. The two panels are collapsible or foldable into overlying relationship with one another in a housing, and a housing cover is adapted to close over the panels to protect them from dirt and the like. In a preferred construction, the cover comprises a timepiece so that the device may be normally used as a watch, whereby the user will be encouraged or will have a tendency to wear it at all times.

The housing is preferably made of metal and may be coated with gold or sliver or other semi-precious metal or the like to make it attractive and suitable to be worn as a timepiece. The face of the timepiece preferably carries an illustration of a caduceous or universally recognized medical emblem so that its function as a medical identification device is readily apparent to rescue or medical personnel.

The foldable panels are preferably made from plastic material, and the panels may be pivotally connected to the case by hinge pins. When the watch, which comprises a cover, is moved to its open position away from the folded panels, the panels are biased to an upright, open position in parallel relationship to one another at opposite ends of the case by spring means engaged between the panels and the case.

Construction is thus simple and economical, and the resulting device is both attractive and easy to use. Moreover, as contrasted with those prior art devices known to applicant, the housing and cover in the present invention protect the film and lens from damage or contamination by foreign matter, and the device serves multiple functions, thereby encouraging its use.

BRIEF DESCRIPTION OF THE DRAWINGS

The foregoing, as well as other objects and advantages of the invention will become apparent from the following detailed description when it is considered in conjunction with the accompanying drawings, wherein like reference characters designate like parts throughout the several views, and wherein:

FIG. 9 is a further enlarged, fragmentary sectional view showing a detail of the device of FIG. 8;

FIG. 10 is a view similar to FIG. 9, showing another detail of the device of FIG. 8;

FIG. 11 is an even further enlarged fragmentary sectional view, with portions broken away, of the device of FIG. 8;

BEST MODE OF CARRYING OUT THE INVENTION

Figures 1, 2, 3, 4, 5:
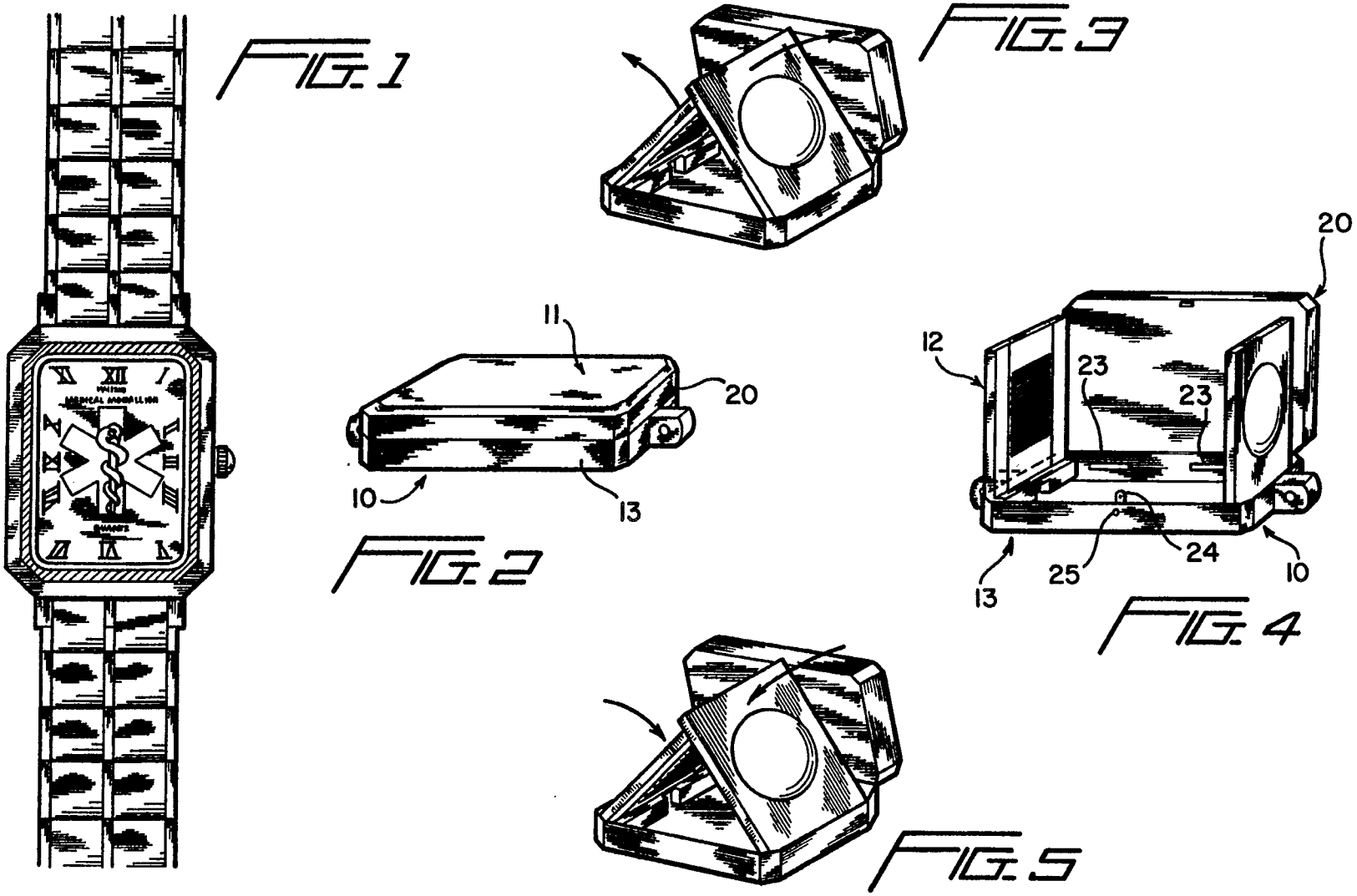
FIG. 1 is a top plan view of a device in accordance with the invention, showing its use as a watch.
FIG. 2 is a top perspective view of the device of FIG. 1.
FIG. 3 is a top perspective view of the device of FIGS. 1 and 2, showing the watch or cover of the housing in an open position, and with the folded panels being biased upwardly toward their operative position for use.
FIG. 4 is a top perspective view of the device of FIGS. 1–3, showing the invention in an unfolded, operative position ready for use as a medical identification device.
FIG. 5 is a perspective view similar to FIG. 3, showing the device being closed into its stored position for use as a watch.
Figure 6:
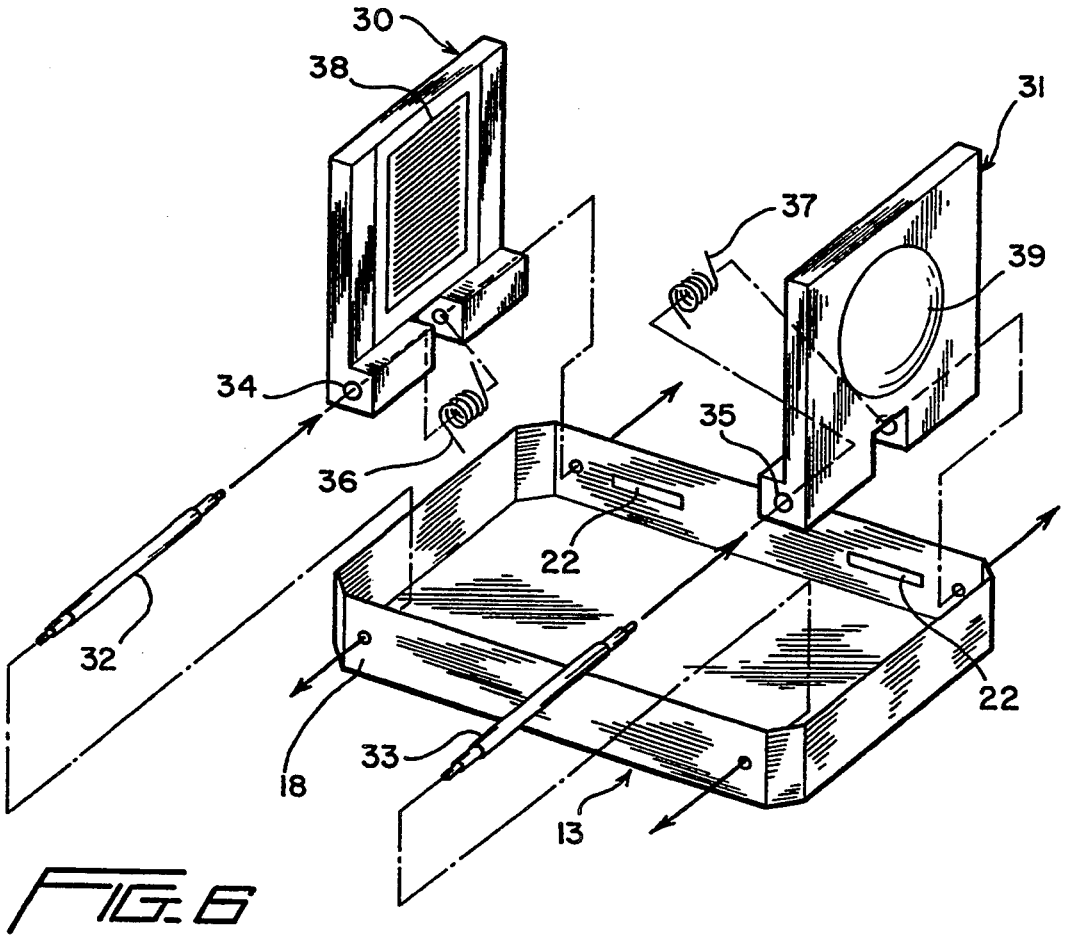
FIG. 6 is an enlarged, top perspective view of the case, foldable panels, hinge pins and springs of the invention.
Figure 7:
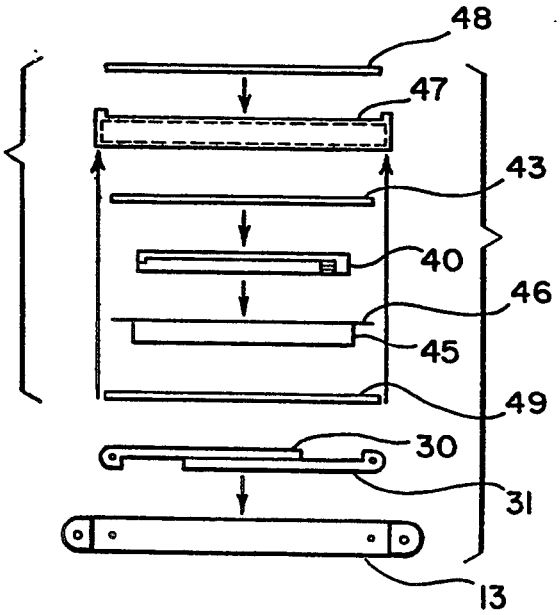
FIG. 7 is an exploded perspective view of the watch components, foldable panels and case of the invention.

A preferred form of device in accordance with the invention is shown at 10 in the drawings, and in the form shown comprises a combination timepiece 11 and identification device 12, carried as separate panels on a case or housing 13 and normally folded into overlying relationship to one another. The device is supported by a band 14, and in normal use looks and functions as a wrist watch, as shown in FIG. 1. The combined wrist watch and identifcation device could equally as well be configured as a pendant watch for suspension from a necklace (not shown), or it could be supported from a bracelet, pin or other means, not shown, as desired.

The housing or case 13 is preferably formed of metal or other suitable material, and has a bottom wall 15, opposite end walls 16 and 17, and opposed front and back walls 18 and 19.

The timepiece or watch also functions as a cover 20 for the identification device 12 and is pivotally connected to the back wall of the housing so that it can be moved between an overlying relationship to the identification device and an upright position exposing the identification device. In one suitable construction, a pair of tabs 21 on the cover are inserted through slots 22 in the back wall 19 and rolled over to form hinges 23 pivotally connecting the cover to the back wall. The cover is held closed or latched to the housing by a latch 24 that is openable by a button actuator 25 on the front wall 18 of the case. Suitable, conventional connecting means 26 is secured to each end wall of the housing to attach the watch band 14.

The identification device 12 comprises a pair of panels 30 and 31 pivotally connected to the case at opposite ends thereof by hinge pins 32 and 33 extended through openings in the front and back walls of the case and through pivot openings 34 and 35 in a base end of the respective panels. The panels are preferably made of plastic, although they may be made of any suitable material. They are biased into an upright position as shown in FIG. 4 by torsion springs 36 and 37 engaged between the respective panels and the bottom wall of the housing. One of the panels 30 carries a piece of microfilm 38 having desired medical information and/or personal identification encoded thereon, and the other panel has a lens 39 with a focal length adapted to focus on the microfilm when the panels are in their upright position as shown in FIG. 4, for example. The information contained on the microfilm may include any desired medical or other personal identification, and may even include an EKG printout.

The timepiece or watch 11, which also functions as a cover when it is in its closed position as shown in FIGS. 1 and 2, comprises a movement 40 carrying movable arms 41 and 42 for indicating hours and minutes, respectively, on a face plate 43 having a caduceous or internationally recognized medical emblem or other indicia 44 thereon. The movement is received within a housing 45 having a peripheral flange 46 against which the face plate 43 is seated in overlying relationship to the movement. This subassembly is then seated within a bezel 47 that is sealed at its top with a transparent member or crystal 48 and at its bottom with a cover plate 49. This entire assembly then constitutes the cover 20 which is pivotally connected to the case 13.

In use, the combined timepiece 11 and cover 20 is unlatched by pressing the button 25, whereby it may then be lifted to its upright position, so that the springs 36 and 37 can urge the panels 30 and 31 upwardly to their upright, parallel position for proper focus of the lens with respect to the microfilm. The device is then aimed at a light source and the information on the microfilm read by viewing it through the lens.

The form of the invention shown in FIGS. 8–24 is functions essentially the same as that form of the invention shown in FIGS. 1–7, with the exceptions described hereinafter.

In FIGS. 8–24, the combined identification device and timepiece 50 comprises a housing or case 51 having a bottom wall 52 opposite side walls 53, opposite end walls 54 and an open top 55. A pair of pivot shafts 56 and 57 extend between the front and back walls at opposite ends, respectively, of the housing for pivotally supporting the identification panel 58 and the lens panel 59, respectively. The pivot shafts may include end portions that extend through openings in the front and back walls, or the pivot shafts may be engaged in pockets or notches inside the housing so that the front and back walls are not penetrated. As in the first form of the invention, a sheet 60 containing desired information is carried by the identification panel 58, and a lens 61 is carried by the lens panel 59.

A suitable timepiece movement 62 is carried in a timepiece case 63 and held in the case by a case back 64 which may be fastened in place with screws 65. When in the closed position shown in FIG. 8, the timepiece case covers the open top of the housing 51 and may be sealed relative thereto by a peripheral seal S engaged between the top margin of the housing and the underside of the case back, to render the assembly waterproof.

The timepiece is held in the closed position by cooperating detents 66 and 67 on an upper front edge of the housing and on a bottom front edge of the case back plate, respectively (see FIGS. 10, 12, 13 and 15–18).

Pivot mounts 68 are secured on the underside of the case back at its rearward edge to pivotally support the timepiece on the housing by a pivot pin 69 (FIG. 9) extended through these pivot mounts and through a corresponding pivot mount 70 on an upper rear edge portion of the housing.

When it is desired to view the information on the identification panel, the timepiece case is grasped and lifted upwardly at its front edge to disengage the detents 66 and 67. As the timepiece is raised as shown in FIGS. 3 and 4, the lens panel 59 is pivoted upwardly by its torsion spring 71, followed by the identification panel 58 under the influence of its torsion spring 72. The timepiece could be of the type having a digital or liquid crystal display, rather than the more conventional rotating hands in the form shown.

Figure 8:
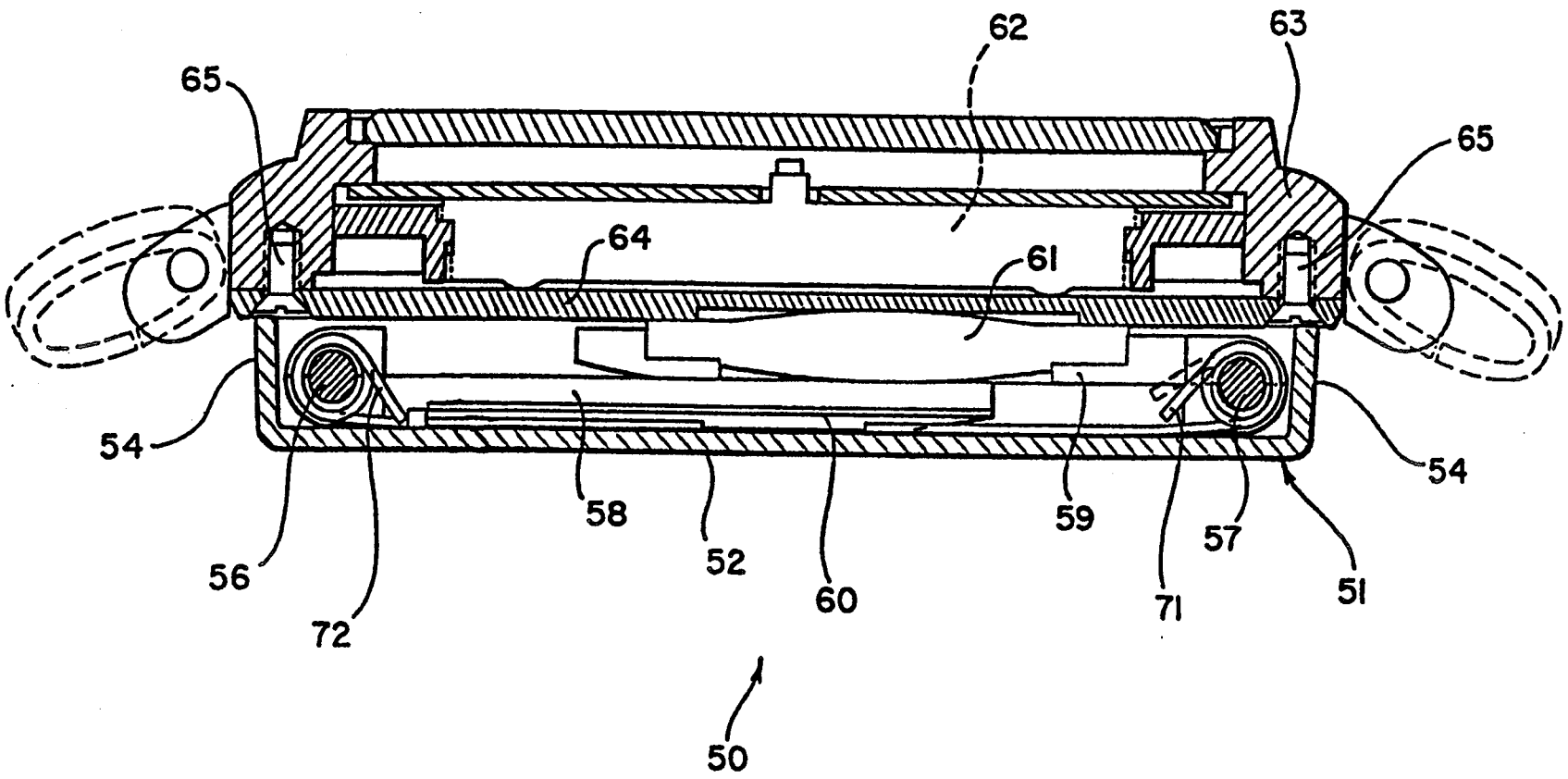
FIG. 8 is an enlarged transverse sectional view of a modified combined identification device and timepiece in accordance with the invention.
Figure 13:
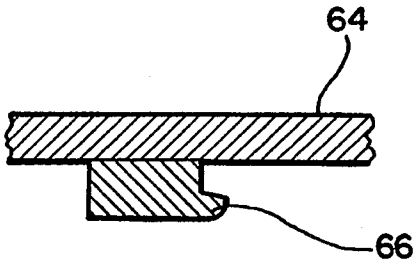
FIG. 13 is an enlarged, fragmentary sectional view taken along line 13—13 in FIG. 12.
Figure 14:
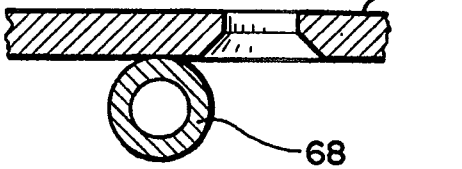
FIG. 14 is an enlarged, fragmentary sectional view taken along line 14—14 in FIG. 12.
Figure 12:
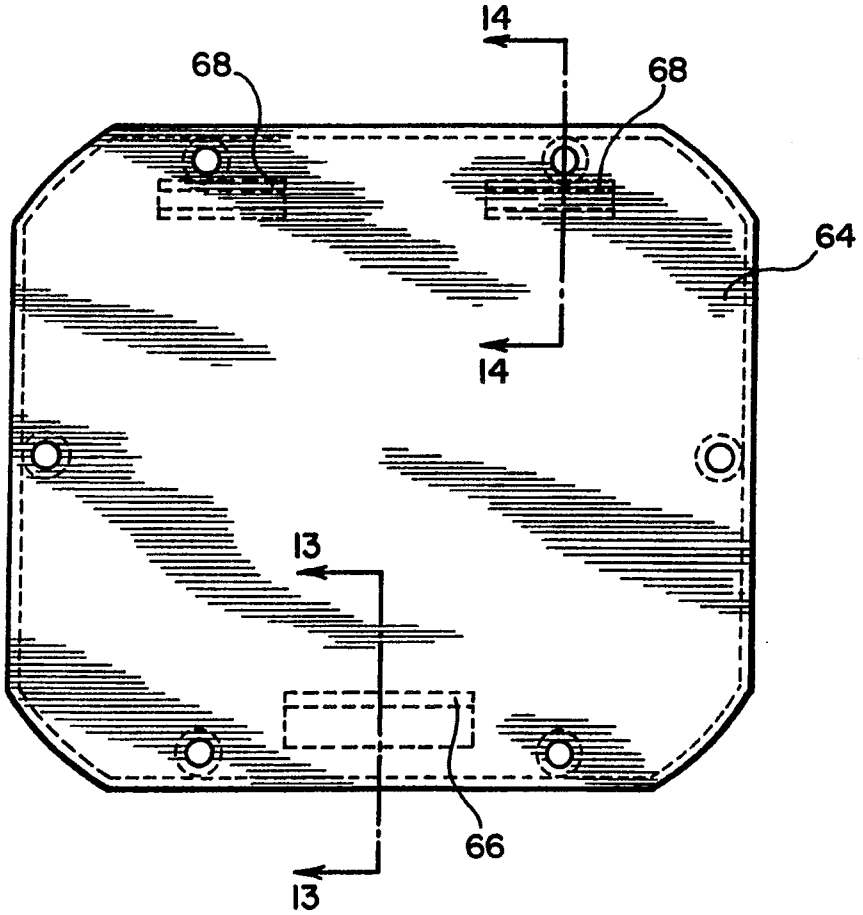
FIG. 12 is a top plan view of the case back for the timepiece used in the form of the invention shown in FIG. 8.
Figure 16:
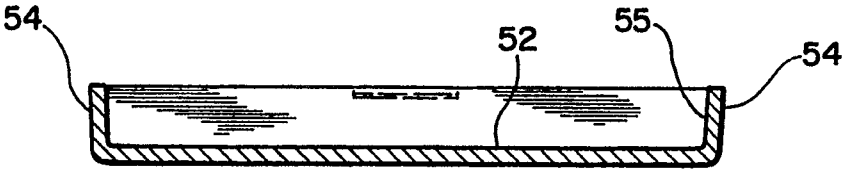
FIG. 16 is a front view in elevation of the housing of FIG. 15.
Figure 15:
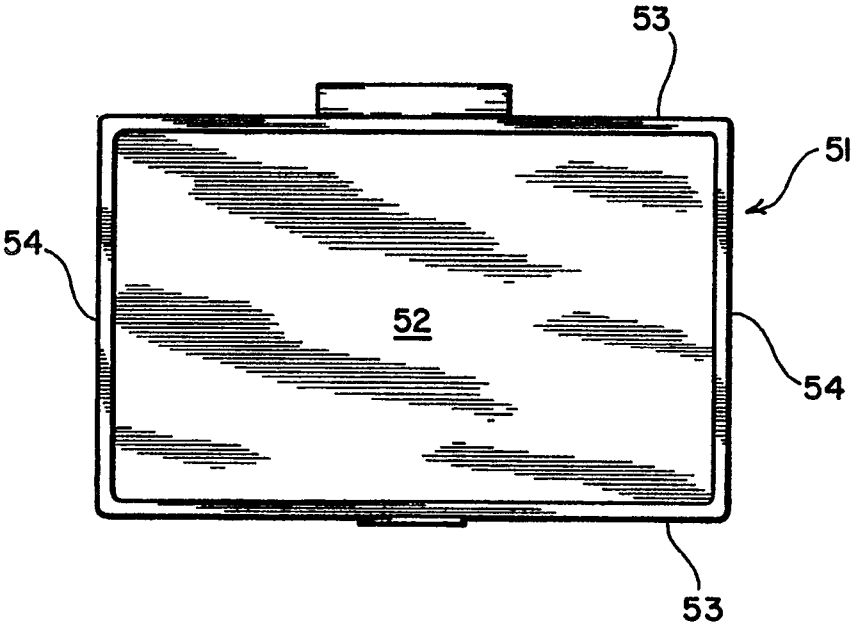
FIG. 15 is a top plan view of the housing for holding the identification material in the form of the invention shown in FIG. 8.
Figure 17:
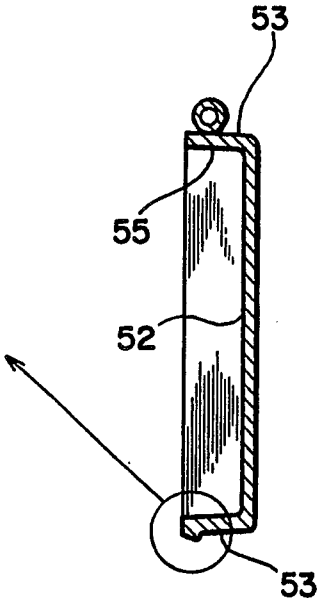
FIG. 17 is an end view of the housing of FIG. 15.
Figure 18:
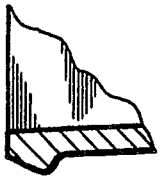
FIG. 18 is an enlarged, fragmentary view of the detail in circle 18 of FIG. 17.
Figure 20:
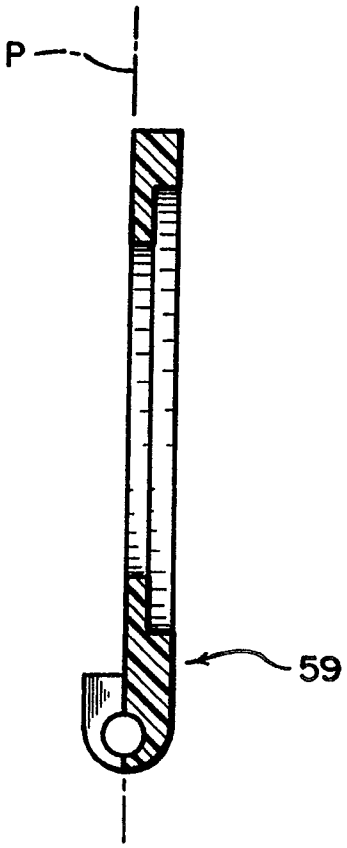
FIG. 20 is a side view in elevation of the lens holder of FIG. 19.
Figure 19:
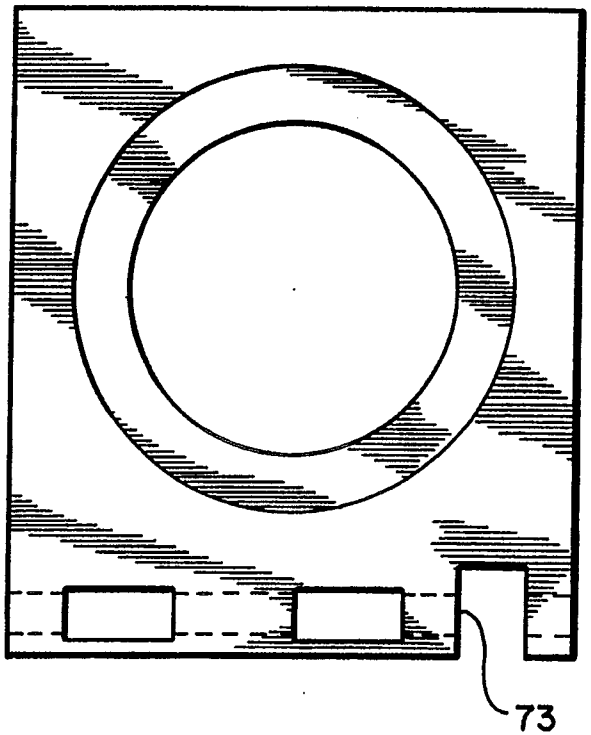
FIG. 19 is a back view in elevation of the lens holder used in the form of the invention shown in FIG. 8.
Figure 21:
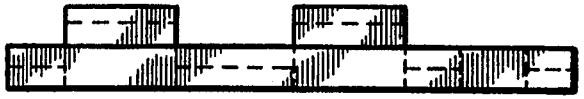
FIG. 21 is an end view of the lens holder of FIG. 19.
Figure 22:
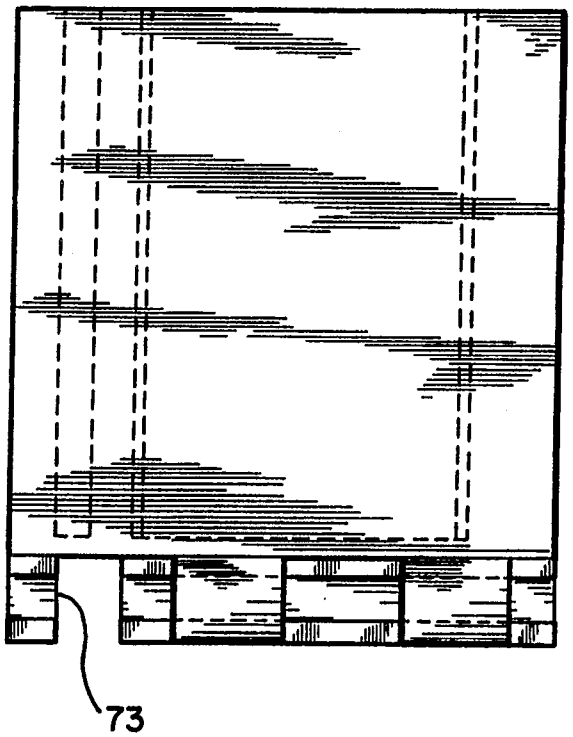
FIG. 22 is a back view in elevation of the identification holder used in the form of the invention shown in FIG. 8.
Figure 24:
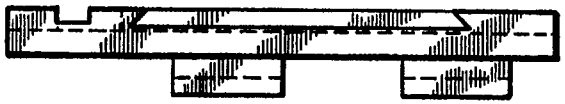
FIG. 24 is an end view of the identification holder of FIG. 22.
Figure 23:
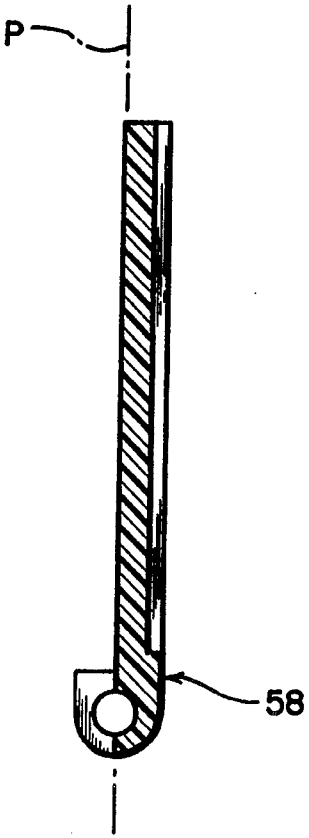
FIG. 23 is a side view in elevation of the identification holder of FIG. 22.

As seen best in FIGS. 8 and 19–24, the identification panel 58 and lens panel 59 are shaped complementally to one another, with each being substantially offset to one side of a plane P bisecting the axis of rotation of the respective panels, whereby the panels are enabled to nest or lie flat against one another when in their closed positions as seen in FIG. 8. Further, a cut out 73 is provided in each panel to accomodate the respective torsion springs.

The identification and lens panels in either form of the invention may be injection molded or otherwise suitably formed from a transparent or translucent plastic material, such as used in viewing X-ray films, for example.

In a specific construction of the invention, the device has a length of about one inch, a width of about three-fourths of an inch, and a combined or overall thickness of about one-quarter to three-eighths of an inch when in its collapsed, folded state. When the panels are unfolded to their upright, operative positions, they have a height from the bottom of the housing to their free upper ends of about three-fourths of an inch. The lens has a diameter of about one-half inch and a focal length of about one inch.

The film on which the medical or personal information is contained is 16 mm color microfilm, and the panels are made from a transparent or translucent plastic material having a thickness of about 0.030 of an inch.

The housing or case (13, 51) may be made of aluminum or steel and the like and then anodized or otherwise suitably coated with a coating or layer of gold or silver or other material to enhance its appearance. The aluminum may have a thickness of only about 0.082 of an inch, if desired, and is exceptionally lightweight.

When not in use, the housing and cover protects the film and lens from damage due to scratching or the like, and also keeps dirt and other foreign matter from collecting on the film and/or lens.

While the invention has been shown and described in detail, this invention is not to be considered as being limited to the exact form disclosed, and changes in detail and construction may be made therein within the scope of the invention, without departing from the spirit thereof.

What is claimed is:

1. A combined timepiece and personal identification device, comprising:

a housing having a bottom wall, front and back walls, opposite end walls, and an openable top cover;

said cover comprising a timepiece with a mechanism and indicia for indicating time;

personal identification means in said housing carrying medical or other personal information related to the person wearing the device, said cover being normally closed on said housing, hiding the means carrying personal identification;

releasable latch means operable to open the cover and expose said personal identification means to gain access to the information thereon;

said personal identification means comprising a first foldable panel mounted about a hinge means in the housing for movement between a stored position in the housing, lying generally parallel to the bottom wall, to an exposed position outside the housing and extending generally perpendicular to the bottom wall, said first panel carrying a piece of microfilm or other suitable miniaturized indicia containing said personal identification and/or medical information related to an individual wearing the device; and a second foldable panel mounted about a hinge means in the housing for movement between a stored position in the housing, lying generally parallel to the housing bottom wall and in stacked relationship to the first panel, to an exposed position extending generally perpendicular to the housing bottom wall and parallel to the first panel, said second panel carrying a lens having a focal length essentially equal to the distance between the two panels when they are in their exposed positions generally parallel to one another.

2. The combination as claimed in claim 1, wherein:

said housing and openable cover define protective means to prevent damage and/or contamination of the film and lens when the panels are in their stored positions inside the housing and the openable cover is closed.

3. The combination as claimed in claim 2, wherein:

the panels are urged toward their opened, operative positions exposed outside the housing by spring means engaged with the panels.

4. The combination as claimed in claim 1, wherein:

the housing and cover are shaped and sized as a wrist watch adapted to be worn on the wrist of a person.

5. The combination as claimed in claim 4, wherein:

the panels are mounted in the housing so that they unfold into their opened, exposed positions against respective opposite end walls of the housing; and the openable cover is pivotally mounted to the back wall.

6. The combination as claimed in claim 3, wherein:

the spring means comprise torsion springs engaged between the respective panels and the housing to urge the panels upwardly into exposed positions when the cover is opened.

7. The combination as claimed in claim 1, wherein:

said timepiece includes a faceplate having universally recognized medical indicia, such as a caduceous, thereon.

8. The combination as claimed in claim 1, wherein:

the housing is formed of metal and the panels are formed of plastic.

9. The combination as claimed in claim 8, wherein:

the housing is coated with a precious metal such as gold or silver or the like.

* * * * *